US005113123A

United States Patent [19]

Noser et al.

[11] Patent Number: 5,113,123

[45] Date of Patent: May 12, 1992

[54] RING SPINNING MACHINE

[75] Inventors: Hans Noser, Neftenbach; Markus Erni, Winterthur, both of Switzerland

[73] Assignee: Rieter Machine Works, Ltd., Winterthur, Switzerland

[21] Appl. No.: 676,882

[22] Filed: Mar. 28, 1991

[30] Foreign Application Priority Data

Apr. 10, 1990 [DE] Fed. Rep. of Germany ..... 4011598

[51] Int. Cl.[5] ..... H02P 5/00

[52] U.S. Cl. ..... 318/106; 318/34; 318/41; 318/66; 318/110; 307/66

[58] Field of Search ..... 307/34, 43, 44, 46, 307/48, 64, 66; 318/34, 41, 46-47, 51, 77-78, 85, 101, 103, 105-109, 906, 715, 721-723, 440-442

[56] References Cited

U.S. PATENT DOCUMENTS 3,515,894 6/1970 Swing et al. ..... 307/64
3,668,418 6/1972 Godard ..... 307/66
4,023,081 5/1977 Murray et al. ..... 318/109
4,096,394 6/1978 Ullmann et al. ..... 307/48 X
4,341,982 7/1982 Lahti et al. ..... 318/107 X
4,423,364 12/1983 Kompelien et al. ..... 318/107 X
4,475,047 10/1984 Ebert, Jr. ..... 307/66
4,518,899 5/1985 Wolf ..... 318/51 X
4,528,459 7/1985 Wiegel ..... 307/66
4,617,497 10/1986 Wolf ..... 318/78

*Primary Examiner*—William M. Shoop, Jr.
*Assistant Examiner*—David Martin
*Attorney, Agent, or Firm*—Francis C. Hand

[57] ABSTRACT

A ring spinning machine with various driving systems 10, 12 for driving spindles, driving arrangements, ring rails and the like is regulated in the case of power failure down to a zero revolution range while maintaining preselected revolution relationships. The driving system which is allocated to the load with the greatest effective inertia serves, at first, for the supply of the other driving system in a generator service. Only in a lower revolution range are the driving systems backed via a battery of relatively low capacity.

20 Claims, 3 Drawing Sheets

RING SPINNING MACHINE

Figure 1:
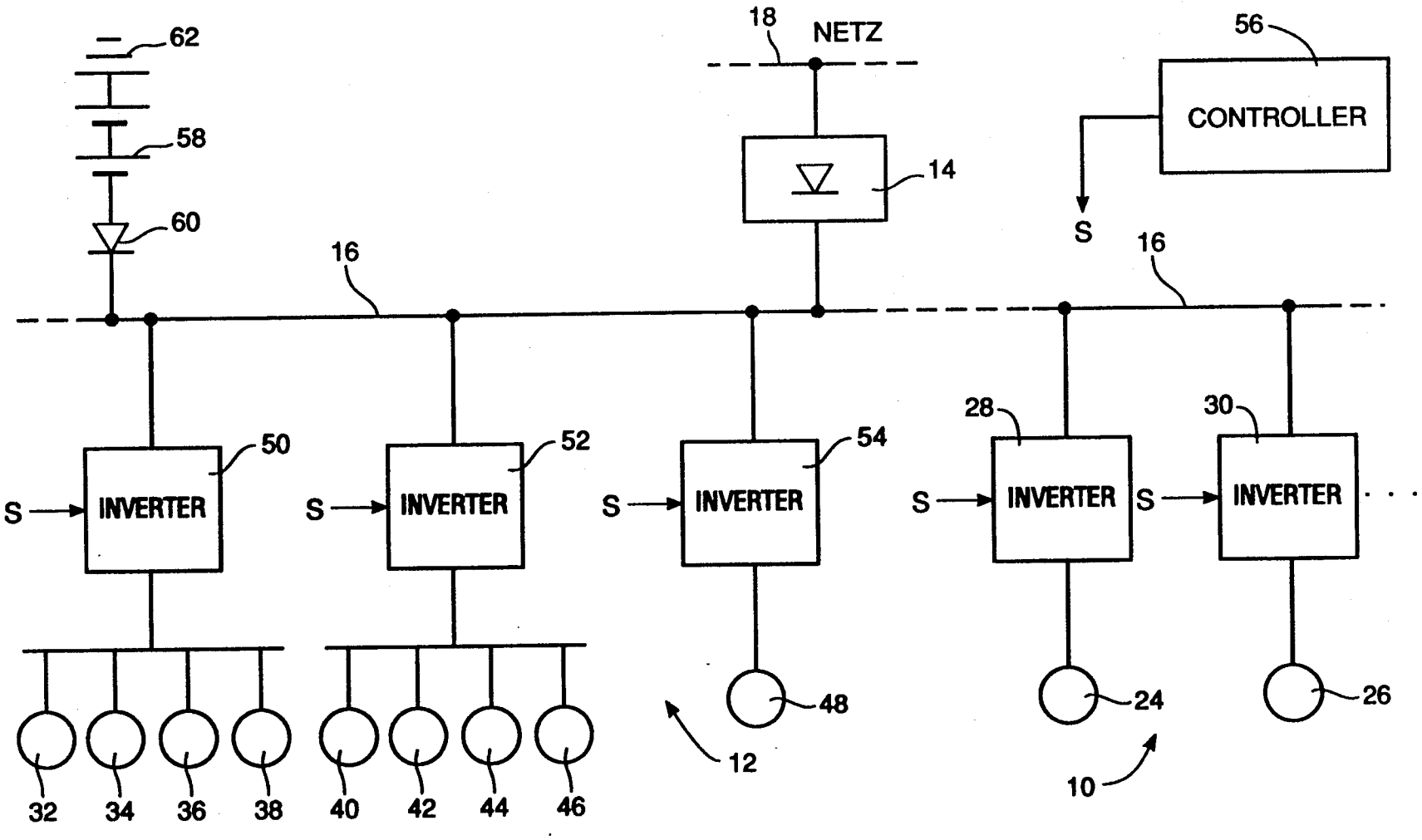

The invention relates to a ring spinning machine. More particularly, this invention relates to a control arrangement for stopping a ring spinning machine in response to a power failure.

Textile machines and ring spinning machines, in particular, require an extremely even run and precise speeds of the driven work elements and, in particular, defined revolution and/or speed relationships of these driving elements. Essential working elements in this context are in particular the spindles, the drafting arrangements as well as the ring carriers or ring rails.

For example, the relation of the revolutions of the spindle to the supply speed is decisive for the.spin and the tenacity of the yarn in order to maintain an even draft. The revolution values of the cylinders of the drafting arrangement must also be in a defined relationship to one another. Also, the movement speed of the ring rails, for example, as well as the relationship of this speed to the preceding speed is of importance for the yarn package formation on the bobbin.

For these indispensable prerequisites to maintain a uniform yarn quality, an extremely critical operational phase must take place with each power failure. As each of the work elements of the ring spinning machine should be separately selectable in order to achieve a higher variability, rigid geared connections between these work elements should be avoided if possible. Furthermore, each power failure brings about an extreme danger of thread breakage, because the drafting arrangement will generally come to a standstill while the spindles keep on turning due to their inherent inertia. One of the causes for an immediate standstill of the drafting arrangement is the fact that the effective inertia potential of the drafting cylinders as opposed to that of the spindles is reduced to a minimum, in particular, because of the arrangement of a gear transmission between the drive motor in question and the cylinder, and the existing friction.

In a spinning or twisting machine as known in U.S. patent application Ser. No. 07/505,162 filed Apr. 5, 1990 and from DE 33 47 113 A1, the kinetic energy of the spinning or twisting organs, i.e., spindles, is, in case of power failure, exploited for energy recuperation and for the supply of the work elements which normally come to a quicker standstill. For this, the electric motors of the spinning or twisting organs function as generators.

In this known machine, a so-called recuperation obviously takes place up to the standstill of the work elements, in particular of the drafting arrangement. However, there exists the danger that in the lower revolution range close to zero, the driving motors to be supplied with emergency power can no longer be controlled or precisely selected. With frequency controlled synchronous motors, for example, the produced moment is dependent on the square of the voltage/frequency relationship. If the corresponding critical values are undershot, the motor comes off shot which in general leads to the immediate standstill of the aggregate in question, for example of a drafting arrangement. Given that the spinning or twisting organs with the greater effective inertia keep on turning, inadmissible changes of the yarn twist or thread breaks may result despite the emergency power supply.

In other conventional textile machines, a similar battery backing of the affected driving systems takes place immediately after the appearance of a power failure. However, one particular disadvantage of this is that the batteries providing the emergency supply must be correspondingly large-sized.

Accordingly, it is an object of the invention to reduce the amount of energy required for bringing a ringspinning machine to a stop in the case of a power failure.

It is another object of the invention to be able to stop a ring-spinning machine in response to a power failure without the need for costly equipment.

It is another object of the invention to provide a relatively simple control arrangement for stopping a ringspinning machine in response to a power failure.

Briefly, the invention provides a control arrangement for stopping a textile machine such as a ring-spinning machine in response to a power failure in the textile machine. The control arrangement includes a first driving system having at least one motor for driving a first load, for example, one or more spindles of a ring-spinning machine, as well as a second driving system having at least one motor for driving a second load with a lower inertia than the first load. For example, the second driving system may employ a pair of motors for driving a supply cylinder of a drafting arrangement, a second pair of motors for driving a back cylinder of the drafting arrangement as well as an intermediate cylinder and a motor for driving one or more ring rails on a spinning machine.

The control arrangement also has a D.C. line connected in common to each driving system and a rectifier connected to the D.C. line for connecting the line to an electrical supply mains Still further, the control arrangement includes an electronic control for controlling the speed of each motor of the respective driving systems independently of each other. Further, this electronic control is responsive to a power failure in order to slow the speed of each motor to a speed range of zero.

In accordance with the invention, a buffer battery is provided along with means for selectively connecting the battery to the D.C. line in response to the speed of the motors falling below a preselected minimum value in the speed range of zero. That is, the buffer battery can only be connected to the electric line after the revolution or speed values fall short of a preselected minimum value ($N_{min}$) in the lower revolution or speed range or after the line voltage has reached a correspondingly lower minimum voltage level than the voltage supplied via the mains.

In operation, immediately following a power failure, automatically and without delay, the driving system for the load with the lower effective inertia is at first supplied by means of energy recuperation from the driving system for the load having the greater effective inertia. When the motor speeds reach the lower critical revolution range near zero, battery backing takes place instead of an emergency supply in the generator service. Thus, in the case of a power failure the supply voltage cannot drop below the voltage level of the buffer battery. As a result, even in the critical lower revolution range, the motors, for example synchronous motors, of the driving systems to be backed can still be controlled and reliably selected. Given that the emergency power supply at first takes place by feedback, or by so-called recuperation, and the buffer battery is connected only at the end of each run-off control, or only when reaching a speed or revolution value close to zero, batteries of the smallest capacity will suffice.

Therefore, a minimum effort continuously assures that, for example, a drafting arrangement with a low effective inertia does not come to an immediate standstill even in case of a power failure. Thus, the drafting arrangement will be supplied with the required energy down to the revolution range of zero, at least for a defined spin off operation, while maintaining the preselected revolution relations With such an automatically actuated emergency power supply of this kind, controlled motion can also be sustained for other drives, such as ring rails or the like, for a sufficiently long period of time.

If, in the case of a power failure, the driving system which is backed via a line in the generator service comprises at least one frequency-controlled electric motor, the minimum voltage level determining the transition to the battery-backing or the battery voltage is chosen in dependence on the lowest admissible voltage/frequency relationship of the frequency-controlled electric motor.

This precludes the voltage for the supply of the frequency-controlled electric motors in question from falling to such a level where the critical voltage/frequency relationship is undershot, at which the motor may slip out of step or come to an abrupt standstill.

Preferably, the buffer battery is connected to the D.C. line via a diode, a thyristor or the like. Here the diode, for example, is polarized in such a way that the buffer battery will be disconnected as long as the line voltage is greater than the battery voltage However, if the line voltage drops under the battery-voltage level, the buffer battery will be connected to the line via the diode so that, for the subsequent operation, all driving systems connected to this line are battery-operated.

In case of a power failure, the driving system backing the line in the generator service, in particular in the case of a ring spinning machine will preferably be the driving system for the spindles.

It is an advantage that the driving system backing the line in the generator service is connected as an emergency supply to at least the driving systems comprising the motor of the drafting arrangement and/or of the ring rail. This ensures that the drafting arrangement showing the smaller inertia will not come to an immediate standstill in case of a power failure, but can be regulated down together with the other drives in accordance with a preselected run-off control, preferably to zero revolution, in a synchronic and controlled manner.

Advantageously, in case of a power failure, the revolutions or speeds of the concerned loads as well as of their relevant revolution or speed relationships, in particular also during the spin-off, can be preselected exclusively by means of the electronic control.

Given that all driving systems, and if necessary also drives within each system, are each electronically selectable instead of a rigid gear coupling being used and that the revolution or speed values as well as the revolution or speed relationships are practically determined only by the electronic control, a relatively high variability is achieved.

Preferably, the driving systems comprise electric motors which are selectable over frequency converters This frequency converter may be formed, for example, by a converter and an inverter. Via such an electronic control, the respective inverter can be set to the nominal frequency to which the allocated electric motor will adjust.

Preferably, the driving systems allocated to the drafting arrangement and/or the ring rail and the driving system allocated to the spindles are supplied with energy from the mains via a common converter over a d.c. line, and the supply of emergency power in cases of power failure takes place over this d.c. line.

For practical reasons, at least the driving systems allocated to the drafting arrangement and the spindles are separately selectable in order to vary the preselected revolution relationships. In particular, the drafting arrangement cylinders may be driven separately in order to, for example, be able to vary the draft.

It is a further advantage if the ring rail as well can be worked and selected individually, in particular for the variation of the preselected speed relationship of spindle/ring rail.

The spindles may be powered in groups or by single motors, and preferably common frequency converters are allocated to these single motors or groups of motors. A separate driving system with several drives may be allocated to the drafting arrangement as a whole. The ring rail may also be powered together with the drafting arrangement or by its own drive. Normally, a separate spindle is allocated to each spinning station, but the drafting arrangement and the ring rail may each include several spinning stations, if suitable also the entire length of the side of a machine.

In case of a ring spinning machine with one drafting arrangement and one ring rail on each side of the machine in accordance with a preferred embodiment, corresponding drafting arrangement hanks as well as the two ring rails can each be jointly selectable.

Since the electronic control normally requires little energy in case of a power failure, the electronic control can be supplied exclusively by the battery. Basically, an emergency supply can be provided via the driving system which may be working in the generator service and is allocated to the loads with the greater effective inertia.

In accordance with another practical embodiment of a ring spinning machine, the driving system allocated to the drafting arrangement and preferably to the ring rail need only be regulated down to a preselected minimum rotation of the cylinders of the drafting arrangement not equal to zero and subsequently be disconnected at least from the driving device. While this leads to the immediate standstill of the driving system, the affected spindles can in general keep on turning slightly. Because of the relatively low rotation this is practically of no effect. An additional braking of the spindles may, however, be provided.

Figure 2:
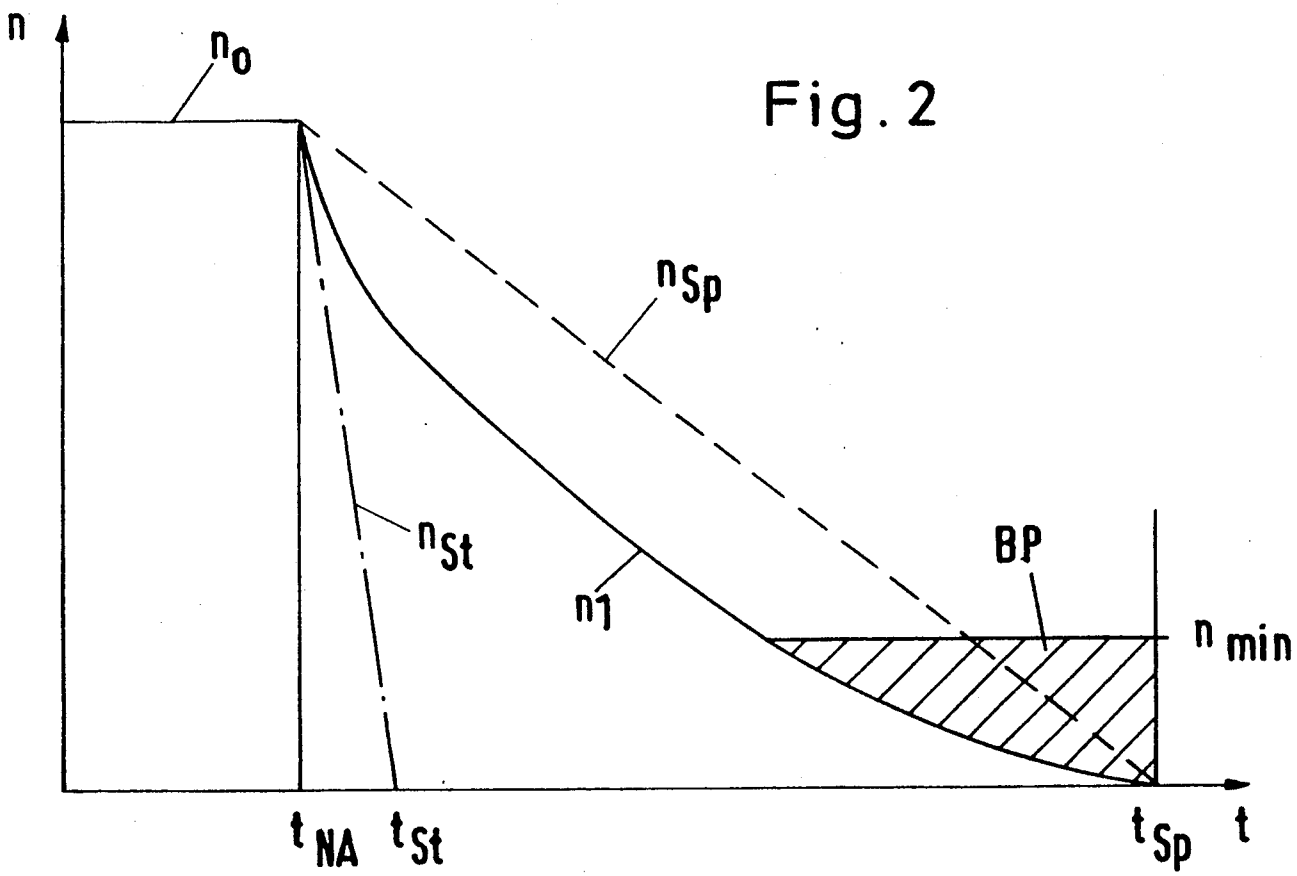
Figure 3:
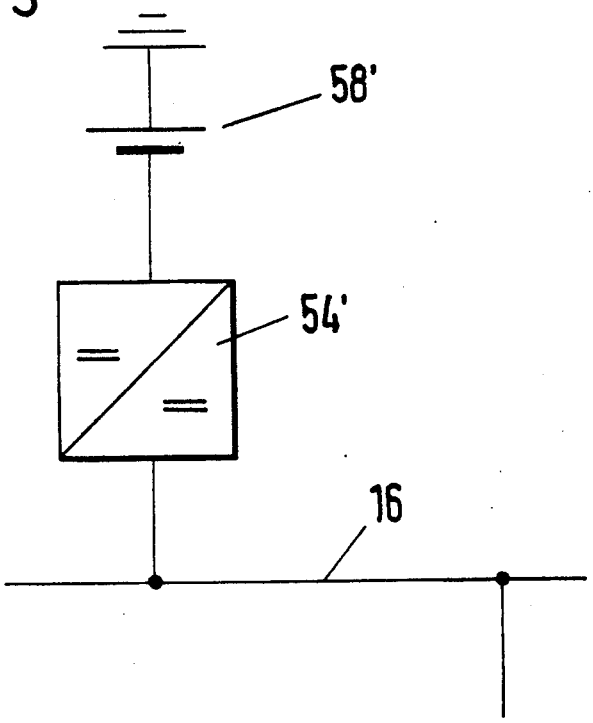

These and other objects and advantages of the invention will become more apparent from the following detailed description taken in conjunction with the accompanying drawings wherein:

FIG. 1 schematically illustrates a control arrangement for a ring spinning machine in accordance with the invention;

FIG. 2 graphically illustrates the operation of the control arrangement during a power failure in accordance with the invention; and FIG. 3 illustrates an alternative embodiment for connecting a buffer battery to the D.C. line of the control arrangement.

Referring to FIG. 1, the ring spinning machine comprises two (only partially represented) driving systems 10, 12. The first driving system 10 serves as a drive for the spindles (not shown) of the ring spinning machine. The second driving system 12 is allocated to two drafting arrangements and two ring rails on the two sides of the ring spinning machine and comprises three drives.

The driving system 12, allocated to the drafting arrangements and the ring rails, and the driving system 10, allocated to the spindles of the ring spinning machine, are supplied with energy via a common converter (rectifier) 14 over a D.C. line or link 16 from a supply mains 18.

As will be specified in detail at a later instance, in case of power failure, an emergency power supply of the driving system 12 first takes place with recuperated energy from the driving system 10 and subsequently is replaced by an emergency power supply of all systems 10, 12 by means of a 58 which is connected on the one end to a grounding 62 battery and selectively connected on the other end to the D.C. line 16 over means, such as a diode 60.

The driving system 10 comprises an a synchronous motor 24, 26 for each spindle which in normal operation is speed-controlled via a supply frequency (only two motors are shown). Each of the a synchronous motors 24, 26 for the spindles is provided with one frequency converter 14, 28; 14, 30 which, besides the rectifier 14, is additionally formed by an inverter 28 or 30.

Furthermore, an electronic control 56 is provided by which in particular the inverters 28, 30 of the spindle drive as well as inverters 50, 52, 54 of the drafting arrangements and ring rails allocated to the second driving system 12 are selectable. The control outputs of the electronic control 56 as well as the control inputs of the inverters have been marked with the letter S.

While only two asynchronous motors 24, 26 of the driving system 10 for the spindles are represented in the drawing, in practical applications, a ring spinning machine may count up to 600 spindles on each machine side for example, and a corresponding number of spindle motors 24, 26 may be provided Each of the motors can be connected to a common frequency converter in the machine end head by means of an energy distribution system. The spindles may however be also driven in groups or even by one motor by means of a tangential belt.

There is no mechanical connection to determine the speed relationship between the spindles and the allocated drafting arrangements. This relationship is determined solely by the electronic control 56.

Referring further to FIG. 1, the second driving system 12 comprises three different drives for the two drafting arrangements and the two ring rails on the two sides of the machine, with the frequency converters 14, 50; 14, 52 and 14, 54, which are formed by the common rectifier 14 (positioned between line 18 and line 16) and the inverters 50 to 54. Therefore, in normal operation, the three drives of the second driving system 12 as well as the spindle drives are supplied with energy via the common rectifier 14 from the supply mains 18 via the D.C. line 16.

Each of the inverters 50, 52, 54 of the three drives of the second driving system 12 for the drafting arrangements and the ring rails is connected to the line or the D.C. line 16. These inverters 50, 52, 54 as well are selectable by the electronic control 56, as alluded to by the arrows S.

The inverter 54 is allocated to an asynchronous motor 48 for the drive of the two ring rails. The motion speed as well as the motion sequence of the ring rails in relation to the spindles are of importance for cop building. The corresponding harmonization takes place via the electronic control 56.

The two drives comprising inverters 50 and 52 are drives for the drafting arrangements. The exact run of the drafting cylinders in comparison to one another and to the spindles is of great importance for the draft and the yarn count. Therefore, synchronous motors 32 to 46 are preferably used as motors for the drafting arrangement. The setup of the two drafting arrangement drives 50, 52 will be set forth hereinunder.

In the present embodiment, the ring spinning machine comprises two drafting arrangements, one on each side of the machine. Each drafting arrangement (not shown) comprises a front or supply cylinder, a middle cylinder and a back or feed cylinder. The cylinders are driven from both ends according to the preselected length (e.g. over 300 spindles per machine side) in order to avoid yarn errors caused by torsion effects in these cylinders along the machine. A separation of the cylinders in the middle may be provided anywhere. For each drafting arrangement supply cylinder, two electric motors, in the present case synchronous motors, are provided.

The four motors 32 to 38 allocated to the inverter 50 are the following kind of motors for the drafting arrangement:

The two synchronous motors 32, 34 are allocated to the two ends of the supply cylinder on the one side of the ring spinning machine, and the synchronous motors 36, 38 are allocated to the two ends of the supply cylinder provided on the other side of the ring spinning machine.

A common inverter 52 is provided for the four synchronous motors 40 to 46. Here, the two synchronous motors 40, 42 are allocated to the two ends of the back and intermediate cylinders on the one side of the ring spinning machine, and the two synchronous motors 44, 46 are allocated to the two ends of the back and intermediate cylinders on the other side of the ring spinning machine. The back and intermediate cylinders on each machine side each comprises one cylinder group and are connected by means of a change gear. Basically, individual drives for the back and the intermediate cylinder may be provided.

The electric motor 48 allocated to the two ring rails may be, for example, an asynchronous motor.

Between each of the motor shafts and the respective end of a drafting cylinder, a, for example, toothed belt transmission, a coupling and a toothed wheel transmission may be provided. In case of the supply cylinder, the installation of a brake between the coupling and the toothed wheel drive is possible in order to, for example, avoid a reversal of the supply cylinder after the spin-off process.

The toothed belt transmission serves as an absorber to absorb shocks produced by the motor at low revolution values and thus protects the sensitive toothed wheel transmission in the area of the drafting cylinders. At the same time, the toothed belt transmission provides the revolution transmission in order to reduce the relatively high revolution value of the respective motor to a lower value at the entry of the relevant coupling. The toothed wheel transmission together with the toothed belt transmission provides the transmission of the torque as to ensure that when the coupling is connected, the motor is not burdened with the high moment of inertia of the idle cylinder.

Consequently, in the present case, the effective inertia of the spindles is much higher than that of the drafting arrangement. Therefore, the drafting arrangement must continue to be powered during each power failure if a premature standstill, which may lead to yarn breakage, is to be avoided.

The power supply during such a power failure takes place at first by means of the asynchronous motors 24, 26 of the spindles which in normal mode function speed-controlled by way of a supply frequency like the other motors. However, in case of a power failure, the motors 24, 26 function as generators in the over synchronous mode for the supply of the second driving system 12 via the D.C. line 16. This exploits the fact that the spindles show a relatively greater effective inertia as compared for example to the drafting arrangement or the ring rail, and the kinetic energy present can be used for the feedback of electric energy to the D.C. line. The inverters 28, 30 are arranged for this kind of energy feedback.

The electronic control 56 comprises a spin-off control, which can also be activated in particular in case of a power failure, in order to slow the driving systems 10, 12 while maintaining defined revolutions or speeds or revolution or speed relations to at least close to the revolution or speed range zero. The regulation to lower revolutions must take place in such a way that after the beginning of a power failure, the asynchronous motors 24, 26 can function as generators.

Given that the electronic control 56 needs only relatively little energy for the continuation of the operation of the drafting arrangements and ring rails as opposed to the second driving system 12, the control 56 may basically be solely battery backed. This, however, is not necessary. This electronic control 56 may also be supplied at least temporarily via the driving system 10 which is allocated to the spindles.

The revolution or speed relations in case of a beginning run-off control during power failure may be preselected via the electronic control 56.

The buffer battery 58, which is additionally allocated to the D.C. line 16, provides the backing of the D.C. line 16 in a lower revolution range. For this, the negative pole of the buffer battery 58 is connected to grounding 62 and the positive pole is connected to the D.C. line 16 via the diode 60 which is connected in the conducting direction.

The voltage of the buffer battery 58 is chosen in such a way that the connection of this battery 58 via the diode 60 takes place only once the revolutions or speeds, in particular of the drives of the driving systems 12 which are to be backed, have fallen below a preselected minimum value $N_{min}$ (see FIG. 2). This implies that the voltage of the buffer battery 58 is clearly lower than the voltage applied to the D.C. line 16 during normal power supply.

For this, the minimum voltage appearing at the D.C. line 16, in case of a power failure at which the buffer battery 58 is connected to the line 16 in order to back the driving system 12, can be selected in dependence on the still admissible voltage/frequency relationship of the electric motors 32–46 which are speed-controlled via a supply frequency. This implies that the voltage applied on the D.C. line 16 cannot, even in case of a power failure, drop below the critical voltage level at which the voltage/frequency relationship required for the continuation of a controlled operation of the motors 32–46 is no longer ensured.

The voltage of the buffer battery 58 must be chosen in such a way to create a voltage on the D.C. line 16, taking into consideration the voltage drop at the diode 60, which must be clearly above the critical voltage level, yet must be low enough in order to keep the capacity of the buffer battery 58 relatively low. Also, in case of a power failure and before the connection of the buffer battery 58, the supply of the driving system 12 takes place via the recuperated energy from the driving system 10 of the spindles.

The function mode of the described ring spinning machine may be seen in the diagram shown in FIG. 2, in which the revolution n is represented over time t.

During the normal mode of operation, i.e. via the supply mains, the electric motors 32–48 and 24, 26 of the driving systems 10, 12 (see FIG. 1) are generally operated at relatively high speed which is shown in FIG. 2 by the revolution value $n_o$. In the graph in FIG. 2 only one such revolution value $n_o$ is listed, but in fact the different driving motors are at least partially operated at varying speeds.

After a power failure at the moment $t_{NA}$ a markedly varying delivery would result for the spindles and the drafting arrangement if there were no backing of the D.C. line 16 (see FIG. 1). Due to the relatively little negative gradient as shown by the broken straight line $n_{sp}$, the revolutions of the spindles would decrease only relatively slowly in case the D.C. line 16 is not backed or the allocated asynchronous motors 24, 26 (see FIG. 1) would come to a standstill at a relatively late moment $t_{sp}$.

Comparatively, the revolutions of the drafting cylinders would drop quicker if the D.C. line 16 were not backed, as shown by the segmented straight line $n_{st}$ at a relatively great gradient. Hence, the drafting arrangement would come to a standstill at an earlier moment $t_{st}$.

In the diagram according to FIG. 2, merely one straight line $n_{st}$ is shown for the representation of the course of speed of the drafting arrangement, but the various drafting cylinders of the drafting arrangements actually turn at varying speeds for the production of the drafts.

The reason why the draft arrangement comes to an earlier standstill $t_{st}$ than the spindles if there is no backing of the D.C. line 16, is because the spindles show a higher inertia than the driving arrangements. Indeed, the driving arrangement would come to a standstill practically immediately after a power failure.

In the described ring spinning machine, such a power failure is detected by the electronic control unit 56 and a preselected spin-off control is started during which the driving systems 10, 12 (see FIG. 1) are preferably regulated down to the revolution range zero while maintaining preselected revolution relationships.

Here, the driving system 12 allocated to the drafting arrangement and preferably also to the ring rail, is backed at first via the D.C. line 16 by means of the driving system 10 operating in the generator service by which energy is fed back into the D.C. line 16. In order to enable the asynchronous motors 24, 26 to work as generators in over synchronous mode, their supply frequencies must be reduced correspondingly, in order to maintain the desired revolution relationships, the synchronous motors 32–48 must be controlled accordingly.

The emergency energy supply of the driving system 12, which is allocated to the driving arrangement and preferably also to the ring rail, via the recuperated energy from the driving system 10 of the spindles does not take place down to the standstill of the machine but merely down to a minimum revolution $n_{min}$ at which the energy supplied by the driving system 10 still suffices for a controlled operation mode of the synchronous motors 32–48.

If the voltage at the D.C. line 16 drops below the minimum voltage level at which a critical voltage/frequency relationship for the synchronous motors 32–48 is reached, a connection of the buffer battery 58 via the diode 60 takes place (see FIG. 1). This implies that the voltage of the buffer battery 58 is at least as high as the minimum voltage determined by the critical voltage/frequency value including the voltage decline at the diode 60. Here, a certain safety distance must be taken into account. On the other hand, the battery voltage should not be greater than the required voltage so that in case of revolutions greater than the minimum evolution $n_{min}$, the emergency power supply following the power failure takes place via the spindle drives 24, 26 operating in oversynchronous mode as generators.

Hence, the battery backing takes place in the lower revolution range BP implying that, as shown by the drawn-through curve $n_l$, during the entire spin-off control down to the final standstill of the machine at the moment t t an unproblematic selecting of all of the drives is possible and hence the retention of the preselected revolution relationships.

The connection of the buffer battery 58 to the D.C. link 16 may also take place via a thyristor or a similar device instead of the diode 60.

Furthermore, at least the drafting arrangements may be decoupled from the allocated driving system before zero revolution is reached.

Referring to FIG. 3, a buffer battery 58, or in general an accumulator may be connected via a d.c./d.c. converter to the D.C. link 16 in order to achieve a higher voltage in the D.C. link 16. Conventional lead accumulators or capacitor batteries may be used as buffer batteries. In the converter 54', the lower voltage of the buffer battery is transformed into the higher voltage in the link.

The invention thus provides a relatively simple and inexpensive control arrangement for stopping a textile machine in response to a power failure. Further, the invention provides a relatively simple arrangement for stopping the drafting arrangements of a ring spinning machine without effecting the speed relationships between the cylinders of the drafting arrangements.

What is claimed is:

1. A ring spinning machine comprising a first driving system having at least one motor for driving at least one spindle;

a second driving system having at least one motor for driving a cylinder of a drafting arrangement;

a D.C. line connected in common to each said driving system;

a rectifier connected to said D.C. line for connecting said line to an electrical supply mains;

an electronic control for controlling the speed of each motor independently of each other, said control being responsive to a power failure to slow the speed of each motor below a preselected minimum value;

a buffer battery; and means for selectively connecting said battery to said D.C. line in response to said speed of said motors falling below said preselected minimum value.

2. A ring spinning machine as set forth in claim 1 wherein said battery has a voltage lower than a voltage supplied to said D.C. line from said rectifier during normal operation.

3. A ring spinning machine as set forth in claim 2 wherein said motor of said second driving system is a frequency-controlled electric motor and wherein said battery voltage is selected in dependence on a minimally admissible voltage/frequency relationship of said frequency-controlled electric motor.

4. A ring spinning machine as set forth in claim 1 wherein said means is a diode connecting said battery to said D.C. line.

5. A ring spinning machine as set forth in claim 1 wherein said means is a D.C./D.C. converter connecting said battery to said D.C. line.

6. A ring spinning machine as set forth in claim 1 wherein said means is a thyristor connecting said battery to said D.C. line.

7. A ring spinning machine as set forth in claim 1 wherein said motor of said first driving system is an asynchronous motor and acts as a generator in response to a power failure to drive said motor of said second driving system.

8. A ring spinning machine as set forth in claim 1 wherein each said motor is an electric motor, said first driving system includes an inverter between said D.C. line and said motor thereof and said second driving system includes an inverter between said D.C. line and said motor thereof.

9. A ring spinning machine as set forth in claim 8 wherein each inverter is an inverse rectifier.

10. A ring spinning machine as set forth in claim 1 which further comprises a second battery connected to said control for actuating said control in response to a power failure.

11. A ring spinning machine as set forth in claim 1 wherein said battery is a capacitor battery.

12. A ring spinning machine comprising a D.C. line;

a rectifier connected to said D.C. line for connecting said line to an electrical supply mains;

a first driving system having a plurality of motors for driving a plurality of spindles and a plurality of inverters, each said inverter being connected to and between a respective motor and said D.C. line;

a second driving system having at least one pair of motors for driving a supply cylinder of a drafting arrangement, at least a second pair of motors for driving a back cylinder of a drafting arrangement in predetermined relation to said supply cylinder, a fifth motor for driving a ring rail and a plurality of inverters, each said inverter being connected to and between a respective motor thereof and said D.C. line;

an electronic control for delivering a control signal to each respective inverter for controlling the speed of each motor connected thereto;

a buffer battery; and means for selectively connecting said battery to said D.C. line in response to a reduction in speed of said motors below a preselected minimum value during a power failure to maintain a voltage in said second driving system sufficient to retain said predetermined relation between the supply cylinder and back cylinder.

13. A ring spinning machine as set forth in claim 12 wherein said means is a diode.

14. A ring spinning machine as set forth in claim 12 wherein each said motor of said first driving system is an asynchronous motor, each motor of each said pair of motors of said second driving system is a synchronous motor and said fifth motor is an asynchronous motor.

15. A ring spinning machine as set forth in claim 12 wherein said motors of said first driving system generate a voltage for driving said motors of said second driving system during an initial phase following a power failure and prior to said motors reaching said preselected minimum value.

16. A ring spinning machine as set forth in claim 15 wherein said electronic control is responsive to a power failure to deliver a control signal to each inverter to effect slowing of a respective motor to a stopped condition.

17. A control arrangement for stopping a textile machine comprising a first driving system having at least one motor for driving a first load;

a second driving system having at least one motor for driving a second load with a lower inertia than said first load;

a D.C. line connected in common to each said driving system;

a rectifier connected to said D.C. line for connecting said line to an electrical supply mains;

an electronic control for controlling the speed of each motor independently of each other, said control being responsive ,to a power failure to slow the speed of each motor below a preselected minimum value;

a buffer battery; and means for selectively connecting said battery to said D.C. line in response to said speed of said motors falling below said preselected minimum value.

18. A control arrangement as set forth in claim 17 wherein said motor of said first driving system generates a voltage for driving said motor of said second driving system during an initial phase following a power failure and prior to said motors reaching said preselected minimum value.

19. A control arrangement as set forth in claim 18 wherein said second driving system has at least one pair of motors for driving a supply cylinder of a drafting arrangement and at least a second pair of motors for driving a back cylinder of the drafting arrangement in a predetermined relation to the supply cylinder and wherein said battery delivers a voltage to said pairs of motors sufficient to retain said predetermined relationship until the cylinders come to a standstill.

20. A control arrangement as set forth in claim 19 wherein said means is one of a diode, thyristor and a D.C./D.C. converter.

* * * * *

UNITED STATES PATENT AND TRADEMARK OFFICE

CERTIFICATE OF CORRECTION

PATENT NO. : 5,113,123

DATED : May 12, 1992

INVENTOR(S) : HANS NOSER, MARKUS ERNI

It is certified that error appears in the above-identified patent and that said Letters Patent is hereby corrected as shown below:

Column 5, line 17 after "of a" insert -battery-
Line 19 cancel "battery"
Lines 21 and 24 change "a synchronous" to -asynchronous- Signed and Sealed this Tenth Day of August, 1993

*Attest:*

Michael K. Kirk

MICHAEL K. KIRK

*Attesting Officer*

*Acting Commissioner of Patents and Trademarks*